US011302522B2

(12) United States Patent
Nishimura et al.

(10) Patent No.: US 11,302,522 B2
(45) Date of Patent: Apr. 12, 2022

(54) FIRST-STAGE DYNODE AND PHOTOMULTIPLIER TUBE

(71) Applicant: HAMAMATSU PHOTONICS K.K., Hamamatsu (JP)

(72) Inventors: Yuki Nishimura, Hamamatsu (JP); Masahiro Kotani, Hamamatsu (JP); Takanori Ichinomiya, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/057,926

(22) PCT Filed: May 28, 2019

(86) PCT No.: PCT/JP2019/021104
§ 371 (c)(1),
(2) Date: Nov. 23, 2020

(87) PCT Pub. No.: WO2019/235300
PCT Pub. Date: Dec. 12, 2019

(65) Prior Publication Data

US 2021/0305033 A1 Sep. 30, 2021

(30) Foreign Application Priority Data

Jun. 6, 2018 (JP) ..... JP2018-108699

(51) Int. Cl.
*H01J 43/20* (2006.01)

(52) U.S. Cl.
CPC ..... *H01J 43/20* (2013.01)

(58) Field of Classification Search
CPC ..... H01J 43/20
See application file for complete search history.

(56) References Cited

U.S. PATENT DOCUMENTS

| | | | |
|---|---|---|---|
| 3,872,337 | A | 3/1975 | Davis et al. |
| 4,112,325 | A | 9/1978 | Faulkner |
| 4,306,188 | A | 12/1981 | Ibaugh |
| 4,446,401 | A | 5/1984 | Faulkner et al. |
| 4,604,545 | A | 8/1986 | McDonie et al. |
| 2006/0220554 | A1 | 10/2006 | Ohmura et al. |

FOREIGN PATENT DOCUMENTS

| | | | |
|---|---|---|---|
| EP | 1708243 | A1 | 10/2006 |
| FR | 2092937 | A6 | 1/1972 |
| JP | 0131518 | C1 | 4/1939 |

(Continued)

OTHER PUBLICATIONS

International Preliminary Report on Patentability dated Dec. 17, 2020 for PCT/JP2019/021104.

*Primary Examiner* — Joseph L Williams
(74) *Attorney, Agent, or Firm* — Faegre Drinker Biddle & Reath LLP

(57) ABSTRACT

A first-stage dynode is a first-stage dynode to be used in a photomultiplier tube, and includes a bottom wall portion and a pair of side wall portions extending from both end portions of the bottom wall portion in a predetermined direction to one side. An electron emission surface is formed by a bottom surface of the bottom wall portion on the one side and a pair of side surfaces of the pair of side wall portions on the one side, and each of the pair of side surfaces is a curved surface that is curved in a concave shape in a cross section parallel to the predetermined direction.

5 Claims, 12 Drawing Sheets

(56) References Cited

FOREIGN PATENT DOCUMENTS

| | | | |
|---|---|---|---|
| JP | S50-026467 | A | 3/1975 |
| JP | H08-012772 | B2 | 2/1996 |
| JP | H09-306416 | A | 11/1997 |
| JP | 2005-197112 | A | 7/2005 |
| RU | 2584693 | A | 10/2014 |
| WO | WO 2014/158507 | A1 | 10/2014 |

(a)

(b)

FIRST-STAGE DYNODE AND PHOTOMULTIPLIER TUBE

TECHNICAL FIELD

The present disclosure relates to a first-stage dynode and a photomultiplier tube.

BACKGROUND ART

As a first-stage dynode to be used in a photomultiplier tube, those having various shapes have been proposed. For example, Patent Literature 1 describes, as a first-stage dynode for the purpose of improving the collection efficiency of photoelectrons, a teacup-shaped first-stage dynode having a flat bottom surface. In the first-stage dynode described in Patent Literature 1, the electron emission surface is formed by the flat bottom surface having a teacup shape. In addition, Patent Literature 2 describes, as a first-stage dynode for the purpose of acquiring a signal current that does not depend on the incidence position of a photocathode, a first-stage dynode in which a receiving port on which photoelectrons are incident has a funnel shape. In the first-stage dynode described in Patent Literature 2, the electron emission surface is formed by one curved surface and three flat surfaces connected to each other so as to be curved in a concave shape, and a pair of side surfaces are provided on both sides of the electron emission surface so as to be perpendicular to the electron emission surface.

CITATION LIST

Patent Literature

Patent Literature 1: U.S. Pat. No. 4,112,325

Patent Literature 2: Japanese Unexamined Patent Publication No. H8-12772

SUMMARY OF INVENTION

Technical Problem

However, in the first-stage dynode described in Patent Literature 1, since the electron emission surface is formed by the flat bottom surface having a teacup shape, it is difficult to adjust the transit time of secondary electrons from the first-stage dynode to the second-stage dynode. As a result, there may be a difference in the transit time of secondary electrons from the first-stage dynode to the second-stage dynode. In addition, in the first-stage dynode described in Patent Literature 2, since a pair of side surfaces are provided on both sides of the electron emission surface so as to be perpendicular to the electron emission surface, secondary electrons emitted from the central region on the electron emission surface travel linearly, while secondary electrons emitted from a region in the vicinity of the side surface on the electron emission surface may repel the side surface with the same electric potential to travel. As a result, there may be a difference in the transit time of secondary electrons from the first-stage dynode to the second-stage dynode. Therefore, in the first-stage dynodes described in Patent Literatures 1 and 2, it is expected that it is difficult to suppress the cathode transit time difference (C. T. T. D) and the transit time spread (T. T. S.) in the photomultiplier tube.

Therefore, it is an object of the present disclosure to provide a first-stage dynode capable of suppressing a cathode transit time difference and a transit time spread in a photomultiplier tube and a photomultiplier tube including such a first-stage dynode.

Solution to Problem

A first-stage dynode according to one aspect of the present disclosure is a first-stage dynode to be used in a photomultiplier tube, and includes: a bottom wall portion; and a pair of side wall portions extending from both end portions of the bottom wall portion in a predetermined direction to one side. An electron emission surface is formed by a bottom surface of the bottom wall portion on the one side and a pair of side surfaces of the pair of side wall portions on the one side, and each of the pair of side surfaces is a curved surface that is curved in a concave shape in a cross section parallel to the predetermined direction.

In this first-stage dynode, each of the pair of side surfaces is a curved surface that is curved in a concave shape in a cross section parallel to the predetermined direction. Therefore, as each side surface becomes farther from the center of the electron emission surface in the predetermined direction, the side surface becomes closer to one electron passage opening. As a result, both the transit distance of the photoelectrons incident on each side surface and the transit distance of the secondary electrons emitted from each side surface become shorter as each side surface becomes closer to one electron passage opening. Therefore, according to this first-stage dynode, it is possible to suppress the cathode transit time difference and the transit time spread in the photomultiplier tube.

In the first-stage dynode according to one aspect of the present disclosure, a radius of curvature of each of the pair of side surfaces may be greater than 2 mm. According to this configuration, it is possible to suitably suppress the cathode transit time difference and the transit time spread in the photomultiplier tube.

In the first-stage dynode according to one aspect of the present disclosure, assuming that a width of the electron emission surface in the predetermined direction is L and a radius of curvature of each of the pair of side surfaces is R, $R \geq 0.1L$ may be satisfied. According to this configuration, it is possible to suitably suppress the cathode transit time difference and the transit time spread in the photomultiplier tube.

In the first-stage dynode according to one aspect of the present disclosure, the bottom surface may be a curved surface that is curved in a concave shape in a cross section perpendicular to the predetermined direction. According to this configuration, it becomes easy to adjust the transit time of the secondary electrons from the first-stage dynode to the second-stage dynode. Therefore, it is possible to suppress the cathode transit time difference and the transit time spread more reliably in the photomultiplier tube.

In the first-stage dynode according to one aspect of the present disclosure, the electron emission surface may face one electron passage opening. According to this configuration, since both the photoelectrons incident on the electron emission surface and the secondary electrons emitted from the electron emission surface pass through one (that is, the same) electron passage opening 11*b*, the dependence of the cathode transit time on the incidence position of photoelectrons is reduced. Therefore, it is possible to suppress the cathode transit time difference and the transit time spread more reliably in the photomultiplier tube.

A photomultiplier tube according to one aspect of the present disclosure includes: a photocathode; a plurality of stages of dynodes; and an anode. The plurality of stages of dynodes include a first-stage dynode and a second-stage dynode arranged on a predetermined plane. The first-stage dynode includes: a bottom wall portion; and a pair of side wall portions extending from both end portions of the bottom wall portion in a predetermined direction to the photocathode side and the second-stage dynode side, the predetermined direction being perpendicular to the predetermined plane. In the first-stage dynode, an electron emission surface is formed by a bottom surface of the bottom wall portion on the photocathode side and the second-stage dynode side and a pair of side surfaces of the pair of side wall portions on the photocathode side and the second-stage dynode side. Each of the pair of side surfaces is a curved surface that is curved in a concave shape in a cross section parallel to the predetermined direction.

According to this photomultiplier tube, it is possible to suppress the cathode transit time difference and the transit time spread for the reasons described above.

Advantageous Effects of Invention

According to the present disclosure, it is possible to provide a first-stage dynode capable of suppressing a cathode transit time difference and a transit time spread in a photomultiplier tube and a photomultiplier tube including such a first-stage dynode.

DESCRIPTION OF EMBODIMENTS

Figure 1:
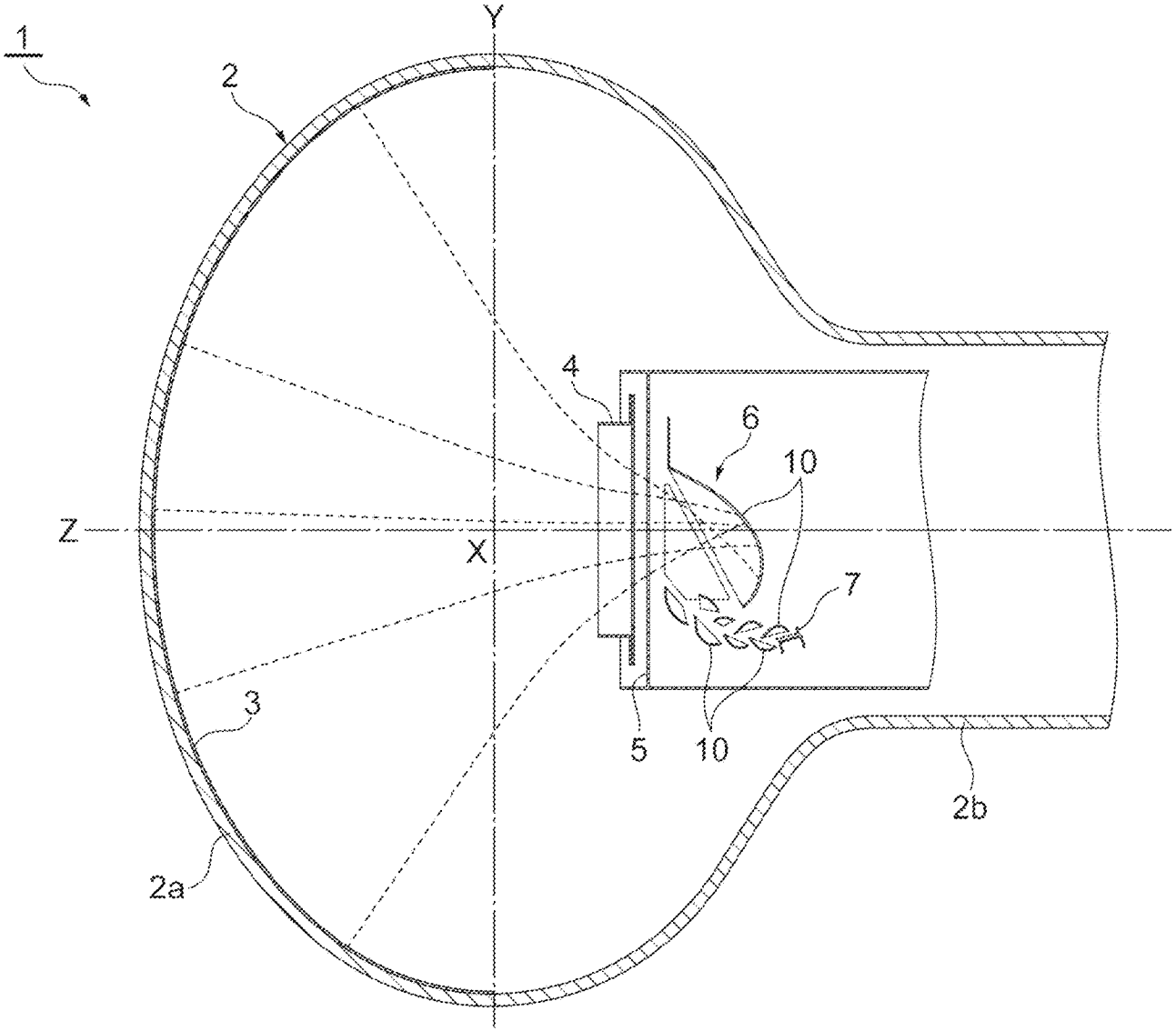
FIG. 1 is a cross-sectional view of a photomultiplier tube according to an embodiment.

Hereinafter, embodiments of the present disclosure will be described in detail with reference to the diagrams. In addition, the same or equivalent portions in the diagrams are denoted by the same reference numerals, and repeated description thereof will be omitted.

[Configuration of Photomultiplier Tube]

As shown in FIG. 1, a photomultiplier tube 1 includes a tube body 2, a photocathode 3, an acceleration electrode 4, a focusing electrode 5, an electron multiplier 6, and an anode 7. The electron multiplier 6 has a plurality of stages (for example, 10 stages) of dynodes 10. In the following description, it is assumed that the side on which light is incident on the photomultiplier tube 1 is "front" and the opposite side is "rear". In addition, it is assumed that the tube axis (central axis) of the tube body 2 is a "Z axis", an axis perpendicular to a plane (a plane including the Z axis) on which the plurality of stages of dynodes 10 are arranged is an "X axis", and an axis perpendicular to the Z axis and the X axis is a "Y axis".

In the tube body 2, the photocathode 3, the acceleration electrode 4, the focusing electrode 5, the electron multiplier 6, and the anode 7 are housed in a vacuumed space. The tube body 2 is a light-transmissive glass bulb. The tube body 2 has an oblate portion 2*a* having the Z axis as its central axis and a cylindrical portion 2*b* having the Z axis as its central axis on the rear side of the oblate portion 2*a*. The oblate portion 2*a* and the cylindrical portion 2*b* are integrally formed as one glass bulb. As an example, the outer diameter of the oblate portion 2*a* is about 200 mm and the outer diameter of the cylindrical portion 2*b* is about 85 mm when viewed from the front side.

The photocathode 3 is provided on the inner surface of the tube body 2. Specifically, the photocathode 3 is provided on the inner surface of the front half region of the oblate portion 2*a*. The photocathode 3 forms a transmissive photocathode, and is formed of, for example, a potassium cesium antimonide/cesium type (bialkali) material or other known materials. When light is incident on the photocathode 3 from the front side, photoelectrons are emitted from the photocathode 3 to the rear side by the photoelectric effect. As an example, the outer diameter of the photocathode 3 when viewed from the front side (that is, the effective diameter of the photomultiplier tube 1) is about 200 mm. In addition, broken lines shown in FIG. 1 indicate the trajectories (representative trajectories) of the photoelectrons emitted from the photocathode 3.

The acceleration electrode 4 is disposed behind the photocathode 3. A predetermined voltage is applied to the acceleration electrode 4. The acceleration electrode 4 is configured to accelerate the photoelectrons emitted from the photocathode 3 toward the electron multiplier 6. The focusing electrode 5 is disposed behind the acceleration electrode 4. A predetermined voltage is applied to the focusing electrode 5. The focusing electrode 5 is configured to focus the photoelectrons emitted from the photocathode 3 toward the electron multiplier 6.

The electron multiplier 6 is disposed behind the focusing electrode 5. The dynodes 10 in a plurality of stages are arranged on a YZ plane (a plane including the Y axis and the Z axis). Each dynode 10 is formed of, for example, stainless steel. A predetermined voltage is applied to each of the plurality of stages of dynodes 10. The electron multiplier 6, that is, the plurality of stages of dynodes 10 are configured to multiply the photoelectrons emitted from the photocathode 3. The anode 7 is disposed on the YZ plane so as to face the final-stage dynode 10. A predetermined voltage is applied to the anode 7. The anode 7 is configured to output the secondary electrons emitted from the final-stage dynode 10 as a signal current.

The acceleration electrode 4, the focusing electrode 5, the dynodes 10 of the electron multiplier 6, and the anode 7 are supported by a support member (not shown) in the tube body 2. The support member is attached to a stem (not shown) that seals a rear end portion of the cylindrical portion 2*b*. In addition, in the stem, a wiring for voltage application and a wiring for signal current output are provided as a stem pin or a cable.

[Structure of Electron Multiplier]

Figure 2:
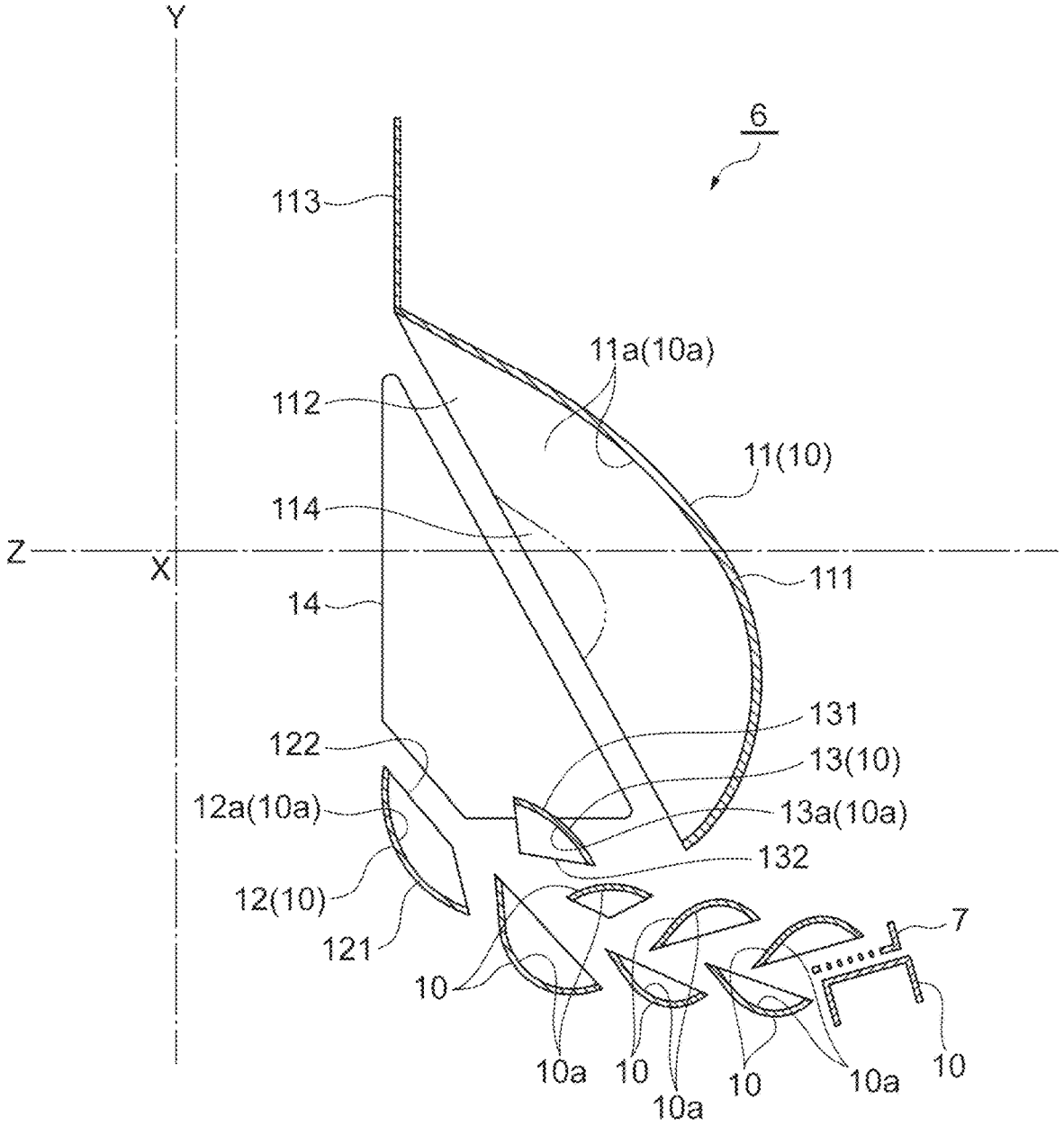
FIG. 2 is a cross-sectional view of an electron multiplier and an anode shown in FIG. 1.

As shown in FIG. 2, in the electron multiplier 6, the plurality of stages of dynodes 10 include a first-stage dynode 11, a second-stage dynode 12, and a third-stage dynode 13. In the following description, respective dynodes including the first-stage dynode 11, the second-stage dynode 12, and the third-stage dynode 13 are collectively referred to as a dynode 10. In addition, electron emission surfaces of the respective dynodes including an electron emission surface 11*a* of the first-stage dynode 11, an electron emission surface 12*a* of the second-stage dynode 12, and an electron emission surface 13*a* of the third-stage dynode 13 are collectively referred to as an electron emission surface 10*a*.

The first-stage dynode 11 is disposed such that the electron emission surface 11*a* faces the photocathode 3 (see FIG. 1) and the electron emission surface 12*a* of the second-stage dynode 12. The second-stage dynode 12 is disposed such that the electron emission surface 12*a* faces the electron emission surface 11*a* of the first-stage dynode 11 and the electron emission surface 13*a* of the third-stage dynode 13. Similarly, each of the dynodes 10 in the third and subsequent stages excluding the final-stage dynode 10 is disposed such that its electron emission surface 10*a* faces the electron emission surface 10*a* of the dynode 10 in the previous stage and the electron emission surface 10*a* of the dynode 10 in the later stage. The final-stage dynode 10 is disposed such that its electron emission surface 10*a* faces the electron emission surface 10*a* of the dynode 10 in the previous stage and the anode 7.

The first-stage dynode 11 has a bottom wall portion 111, a pair of side wall portions 112, a first holding portion 113, and a pair of second holding portions 114 (details thereof will be described later). The electron emission surface 11*a* of the first-stage dynode 11 is formed by the bottom surface of the bottom wall portion 111 on the photocathode 3 side and the second-stage dynode 12 side and a pair of side surfaces of the pair of side wall portions 112 on the photocathode 3 side and the second-stage dynode 12 side.

The second-stage dynode 12 has a bottom wall portion 121 and a pair of holding portions 122. The electron emission surface 12*a* of the second-stage dynode 12 is formed by the bottom surface of the bottom wall portion 121 on the first-stage dynode 11 side and the third-stage dynode 13 side. The pair of holding portions 122 extend from both end portions of the bottom wall portion 121 in the X-axis direction (direction parallel to the X axis) to the first-stage dynode 11 side and the third-stage dynode 13 side.

The third-stage dynode 13 has a bottom wall portion 131 and a pair of holding portions 132. The electron emission surface 13*a* of the third-stage dynode 13 is formed by the bottom surface of the bottom wall portion 131 on the second-stage dynode 12 side and the fourth-stage dynode 10 side. The pair of holding portions 132 extend from both ends of the bottom wall portion 131 in the X-axis direction to the second-stage dynode 12 side and the fourth-stage dynode 10 side.

A pair of electron lens forming electrodes 14 are provided in a region between the first-stage dynode 11, the second-stage dynode 12, and the third-stage dynode 13. Specifically, one electron lens forming electrode 14 is formed integrally with the one holding portion 132 so as to extend in a region between the one second holding portion 114 and the one holding portion 122. The other electron lens forming electrode 14 is formed integrally with the other holding portion 132 so as to extend in a region between the other second holding portion 114 and the other holding portion 122. A predetermined voltage applied to the third-stage dynode 13 is applied to the pair of electron lens forming electrodes 14. As a result, the electric potential distribution in the X-axis direction is made flat in a region between the first-stage dynode 11 and the second-stage dynode 12.

[Configuration of First-Stage Dynode]

Figure 3:
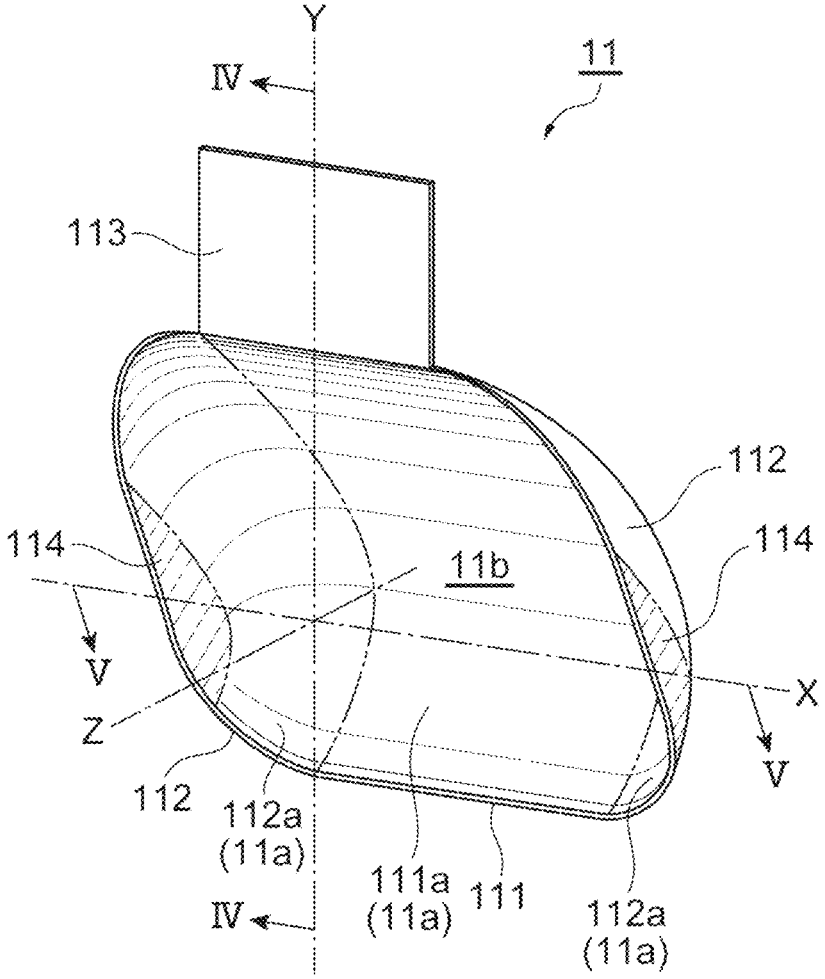
FIG. 3 is a perspective view of a first-stage dynode according to one embodiment.
Figure 4:
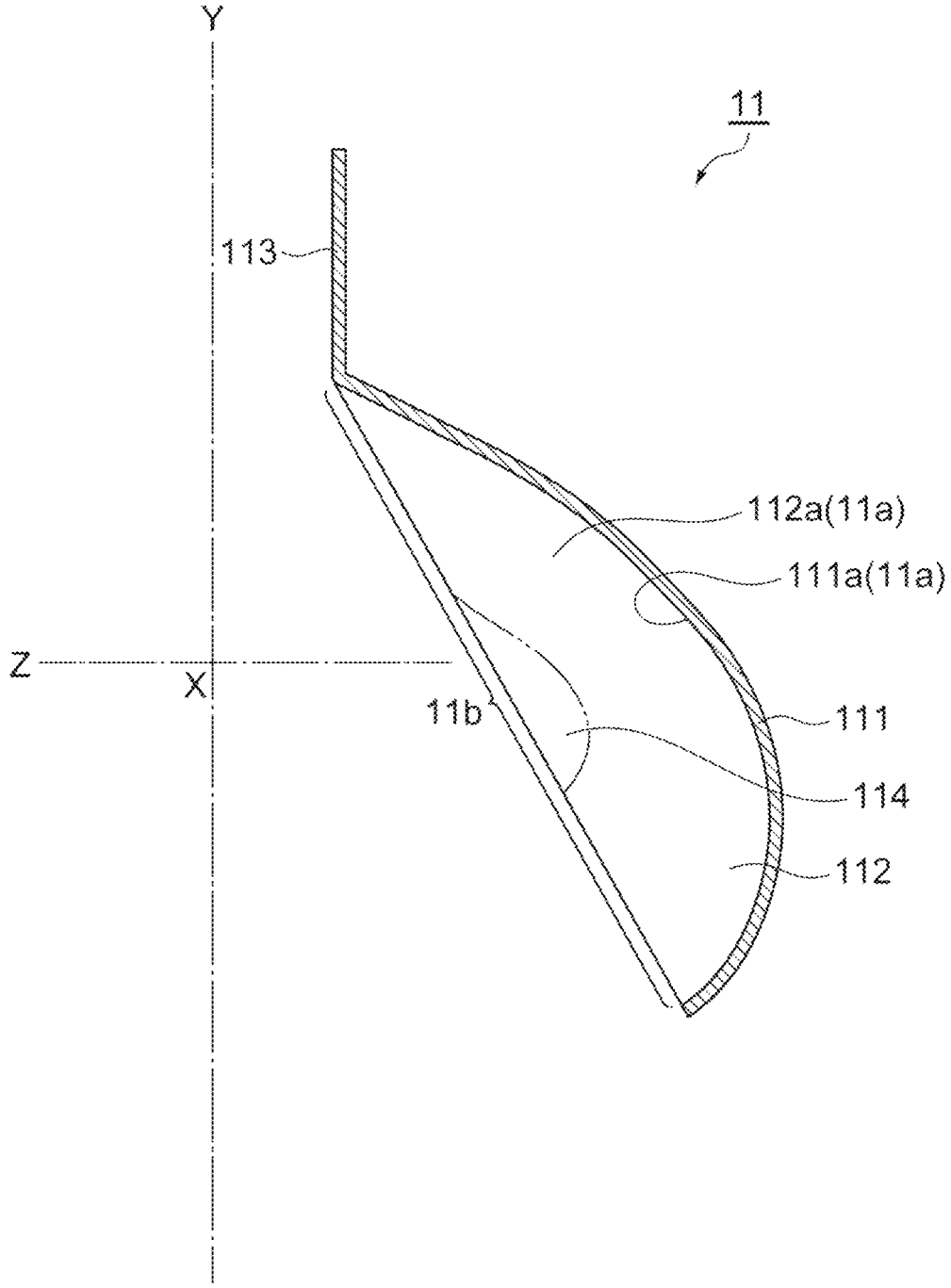
FIG. 4 is a cross-sectional view of the first-stage dynode taken along line IV-IV shown in FIG. 3.
Figure 5:
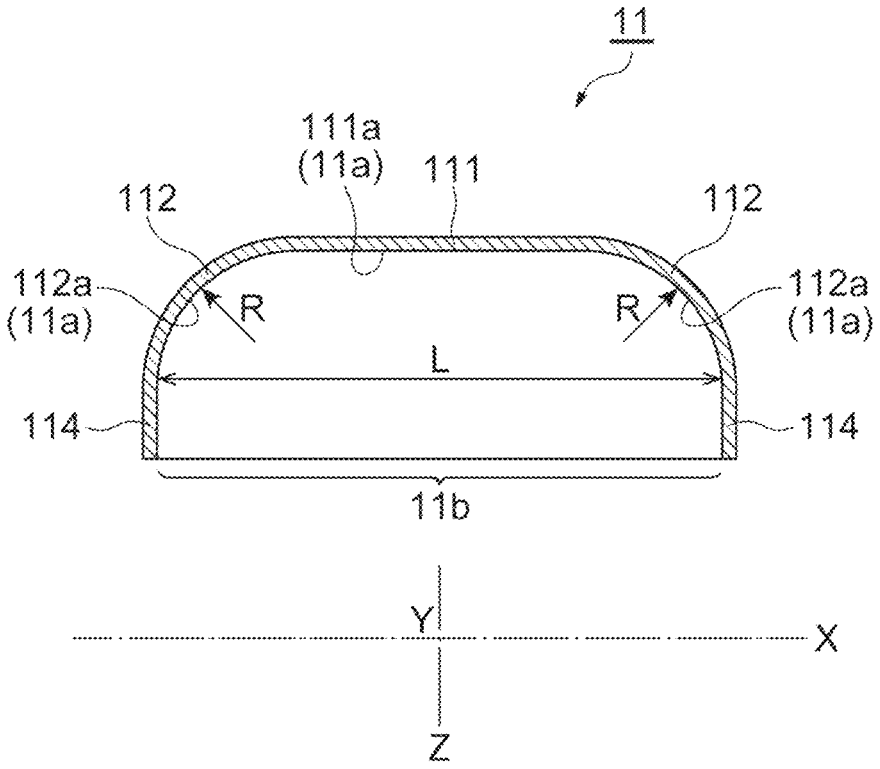
FIG. 5 is a cross-sectional view of the first-stage dynode taken along line V-V shown in FIG. 3.

As shown in FIGS. 3, 4, and 5, the first-stage dynode 11 includes the bottom wall portion 111, a pair of side wall portions 112, the first holding portion 113, and a pair of second holding portions 114. The pair of side wall portions 112 extend from both end portions of the bottom wall portion 111 in the X-axis direction (predetermined direction perpendicular to a predetermined plane) to one side (the photocathode 3 side and the second-stage dynode 12 side (see FIGS. 1 and 2)). The first holding portion 113 extends outward (on a side opposite to the second-stage dynode (see FIGS. 1 and 2)) from the end portion of the bottom wall portion 111 on the front side (photocathode 3 side (see FIGS. 1 and 2)). The pair of second holding portions 114 extend from both end portions of the pair of side wall portions 112 in the X-axis direction to one side.

The first holding portion 113 has a flat plate shape (for example, a rectangular plate shape) parallel to the XY plane. Each of the pair of second holding portions 114 has a flat plate shape parallel to the YZ plane. The first-stage dynode 11 is attached to a support member provided in the tube body 2 through the first holding portion 113 and the pair of second holding portions 114.

The electron emission surface 11*a* of the first-stage dynode 11 is formed by a bottom surface 111*a* of the bottom wall portion 111 on one side and a pair of side surfaces 112*a* of the pair of side wall portions 112 on one side. The electron emission surface 11*a* faces one electron passage opening 11*b*. In the first-stage dynode 11, one electron passage opening 11*b* is defined by the bottom wall portion 111, the pair of side wall portions 112, and edge portions of the pair of second holding portions 114 on one side. That is, both the photoelectrons incident on the electron emission surface 11*a* and the secondary electrons emitted from the electron emission surface 11*a* pass through one (that is, the same) electron passage opening 11*b*.

The bottom surface 111*a* forming the electron emission surface 11*a* is a curved surface that is curved in a concave shape in a cross section perpendicular to the X-axis direction (see particularly FIG. 4). In the present embodiment, the bottom surface 111*a* is a cylindrical surface (elliptic cylindrical surface, hyperbolic cylindrical surface, parabolic cylindrical surface, composite surface thereof, and the like) having the X-axis direction as its longitudinal direction (cylinder height direction). Each of the pair of side surfaces 112*a* forming the electron emission surface 11*a* is a curved surface that is curved in a concave shape in a cross section parallel to the X-axis direction (see particularly FIG. 5). In the present embodiment, each side surface 112*a* corresponds to a chamfered surface when a round inner chamfer is applied to a corner portion formed by the bottom surface 111*a* and the inner surface of each second holding portion 114. In addition, the bottom surface 111*a* and each side surface 112*a* are connected to each other so that the curvatures are continuous. In addition, each side surface 112*a* and the inner surface of each second holding portion 114 are also connected to each other so that the curvatures are continuous.

Assuming that the width of the electron emission surface 11*a* in the X-axis direction is L and the radius of curvature of each of the pair of side surfaces 112*a* is R (see FIG. 5), R≥0.1L is satisfied in the first-stage dynode 11. In addition, the radius of curvature R of each of the pair of side surfaces 112*a* is greater than 2 mm. As an example, the width L of the electron emission surface 11*a* in the X-axis direction is greater than 20 mm and smaller than 50 mm.

The first-stage dynode 11 having the above-described shape is integrally formed by a metal plate (for example, a stainless steel plate having a thickness of about 0.3 mm). That is, the bottom wall portion 111, the pair of side wall portions 112, the first holding portion 113, and the pair of second holding portions 114 are integrally formed by a metal plate. Here, being integrally formed by the metal plate means being formed by performing plastic working, such as press working, on the metal plate.

[Operations and Effects]

In the first-stage dynode 11, each of the pair of side surfaces 112*a* forming the electron emission surface 11*a* is a curved surface that is curved in a concave shape in a cross section parallel to the X-axis direction. Therefore, as each side surface 112*a* becomes farther from the center of the electron emission surface 11*a* in the X-axis direction, the side surface 112*a* becomes closer to one electron passage opening 11*b*. As a result, both the transit distance of the photoelectrons incident on each side surface 112*a* and the transit distance of the secondary electrons emitted from each side surface 112*a* become shorter as each side surface 112*a* becomes closer to one electron passage opening 11*b*. Therefore, according to the first-stage dynode 11, it is possible to suppress the cathode transit time difference and the transit time spread in the photomultiplier tube 1.

In addition, even if the entire electron emission surface is formed in a spherical shape, for example, in the first-stage dynode having such an electron emission surface, it is difficult to adjust the transit time of the secondary electrons from the first-stage dynode to the second-stage dynode. Therefore, it is difficult to effectively suppress the cathode transit time difference and the transit time spread in the photomultiplier tube. In addition, in order to suppress the cathode transit time difference and the transit time spread, it may be considered that the electron emission surface is formed only by the bottom surface 111*a* without providing the pair of side surfaces 112*a* to increase the width of the electron emission surface in the X-axis direction. However, in the first-stage dynode having such an electron emission surface, since the size is large, the outer diameter of the cylindrical portion 2*b* of the tube body 2 should be made large. Therefore, it is difficult to secure the water pressure resistance of the tube body 2. In addition, when the size of the first-stage dynode increases, it is difficult to form the first-stage dynode by performing plastic working, such as press working, on the metal plate. According to the first-stage dynode 11 described above, it is possible to suppress the cathode transit time difference and the transit time spread in the photomultiplier tube 1 while suppressing an increase in the size thereof.

In addition, in the first-stage dynode 11, the radius of curvature R of each of the pair of side surfaces 112*a* is greater than 2 mm. With this configuration, it is possible to suitably suppress the cathode transit time difference and the transit time spread in the photomultiplier tube 1.

In addition, in the first-stage dynode 11, assuming that the width of the electron emission surface 11*a* in the X-axis direction is L and the radius of curvature of each of the pair of side surfaces 112*a* is R, R≥0.1L is satisfied. With this configuration, it is possible to suitably suppress the cathode transit time difference and the transit time spread in the photomultiplier tube 1.

In addition, in the first-stage dynode 11, the bottom surface 111*a* forming the electron emission surface 11*a* is a curved surface that is curved in a concave shape in a cross section perpendicular to the X-axis direction. With this configuration, it becomes easy to adjust the transit time of the secondary electrons from the first-stage dynode 11 to the second-stage dynode 12. Therefore, it is possible to suppress the cathode transit time difference and the transit time spread more reliably in the photomultiplier tube 1.

In addition, in the first-stage dynode 11, the electron emission surface 11*a* faces one electron passage opening 11*b*. With this configuration, since both the photoelectrons incident on the electron emission surface 11*a* and the secondary electrons emitted from the electron emission surface 11*a* pass through one (that is, the same) electron passage opening 11*b*, the dependence of the cathode transit time on the incidence position of photoelectrons is reduced. Therefore, it is possible to suppress the cathode transit time difference and the transit time spread more reliably in the photomultiplier tube 1.

Here, the reason why a difference in the transit time of secondary electrons up to the second-stage dynode 12 is unlikely to occur in the first-stage dynode 11 described above will be described in more detail.

Figure 6:
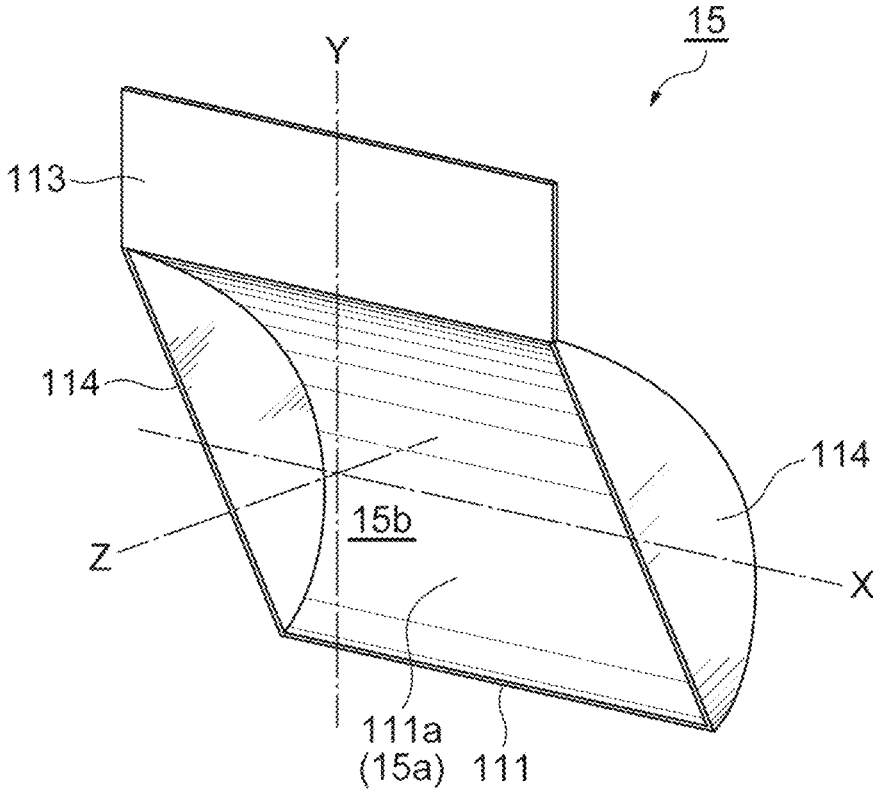
FIG. 6 is a perspective view of a first-stage dynode as a comparative example.

FIG. 6 is a perspective view of a first-stage dynode 15 as a comparative example. As shown in FIG. 6, the first-stage dynode 15 as a comparative example is mainly different from the first-stage dynode 11 described above in that the pair of side wall portions 112 are not provided and the pair of second holding portions 114 cross the bottom wall portion 111. In the first-stage dynode 15 as a comparative example, an electron emission surface 15*a* facing one electron passage opening 15*b* is formed by the bottom surface 111*a*.

Figure 7:
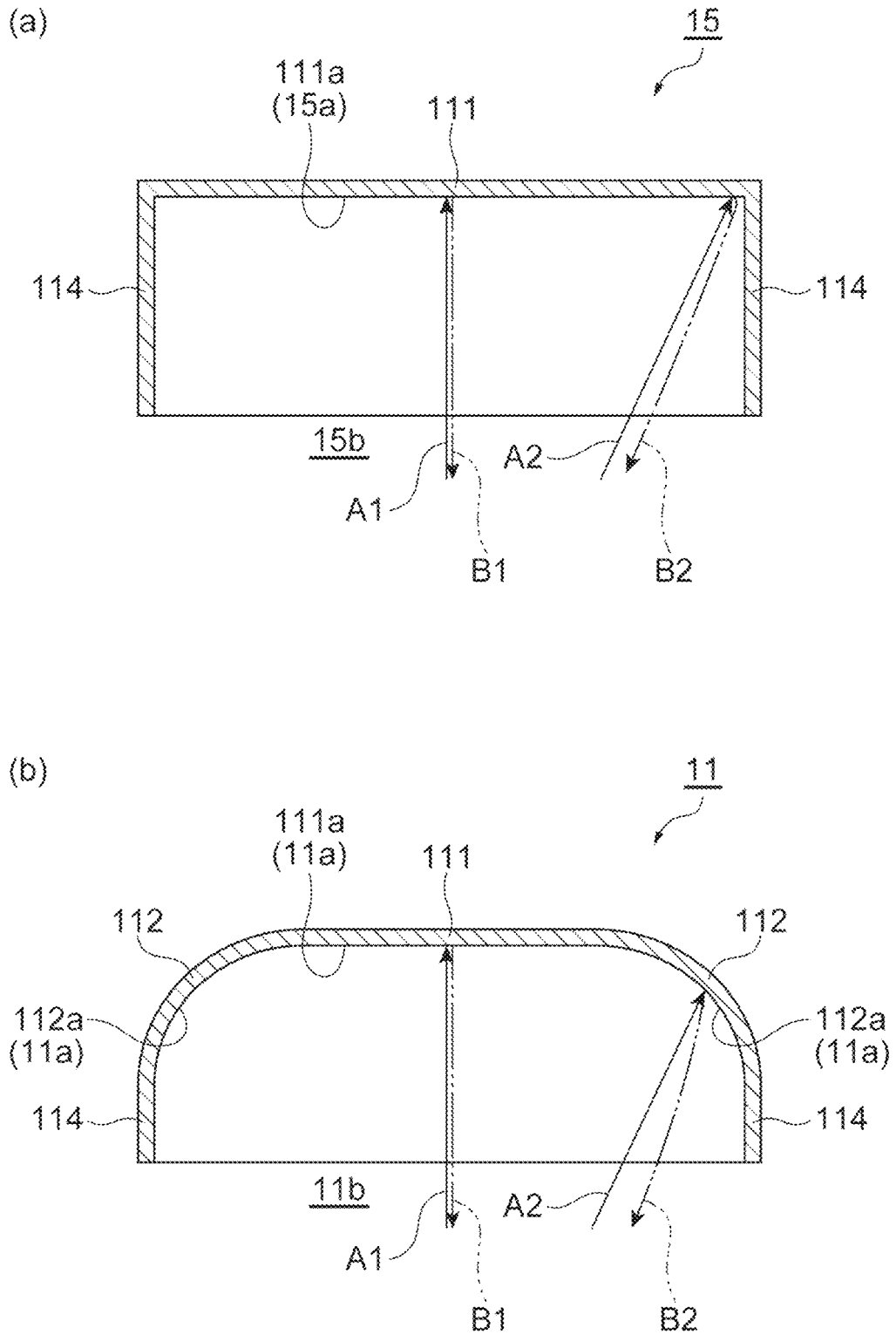
FIG. 7 is a schematic diagram for describing the traveling trajectory of electrons.

In the first-stage dynode 15 as a comparative example, as shown in (a) of FIG. 7, secondary electrons that are emitted from the central region of the electron emission surface 15*a* due to photoelectrons being incident on the central region along a trajectory A1 travel linearly along a trajectory B1. Meanwhile, secondary electrons that are emitted from a region in the vicinity of the second holding portion 114 on the electron emission surface 15*a* due to photoelectrons being incident on the vicinity region along a trajectory A2 repel the second holding portion 114 with the same electric potential to travel along a trajectory B2. As a result, in the first-stage dynode 15 as a comparative example, a difference in the transit time of the secondary electrons up to the second-stage dynode 12 is likely to occur.

On the other hand, in the first-stage dynode 11 described above, as shown in (b) of FIG. 7, secondary electrons that are emitted from the central region of the electron emission surface 11*a* due to photoelectrons being incident on the central region along the trajectory A1 travel linearly along the trajectory B1. Meanwhile, secondary electrons that are emitted from a region (that is, the side surface 112*a*) in the vicinity of the second holding portion 114 on the electron emission surface 11*a* due to photoelectrons being incident on the vicinity region along the trajectory A2 repel the second holding portion 114 with the same electric potential to travel along the trajectory B2, but both the transit distance of the photoelectrons incident on the vicinity region and the transit distance of the secondary electrons emitted from the vicinity region become shorter as the side surface 112*a* becomes closer to the electron passage opening 11*b*. As a result, in the first-stage dynode 11 described above, a difference in the transit time of secondary electrons up to the second-stage dynode 12 is unlikely to occur.

Next, the reason why it is more preferable that the radius of curvature R of each of the pair of side surfaces 112*a* forming the electron emission surface 11*a* is greater than 2 mm in the first-stage dynode 11 will be described together with the simulation result.

First, as a simulation model, a first-stage dynode as a first example, a first-stage dynode as a second example, a first-stage dynode as a third example, and a first-stage dynode as a fourth example were prepared. Each first-stage dynode corresponds to one formed by pressing a stainless steel plate having a thickness of 0.3 mm. In each of the first-stage dynodes, the width L of the electron emission surface in the X-axis direction was 30.6 mm.

The respective first-stage dynodes have the same configuration as the above-described first-stage dynode 11, but are different from each other only in the following point. That is, the radius of curvature R was 2 mm in the first-stage dynode as the first example, the radius of curvature R was 4 mm in the first-stage dynode as the second example, the radius of curvature R was 6 mm in the first-stage dynode as the third example, and the radius of curvature R was 8 mm in the first-stage dynode as the fourth example.

In a simulation corresponding to a case where the first-stage dynode as the first example, the first-stage dynode as the second example, the first-stage dynode as the third example, and the first-stage dynode as the fourth example were attached to the same photomultiplier tube and the photomultiplier tube was operated under the same conditions, the cathode transit time difference and the transit time spread in the X-axis direction were measured.

Figure 8:
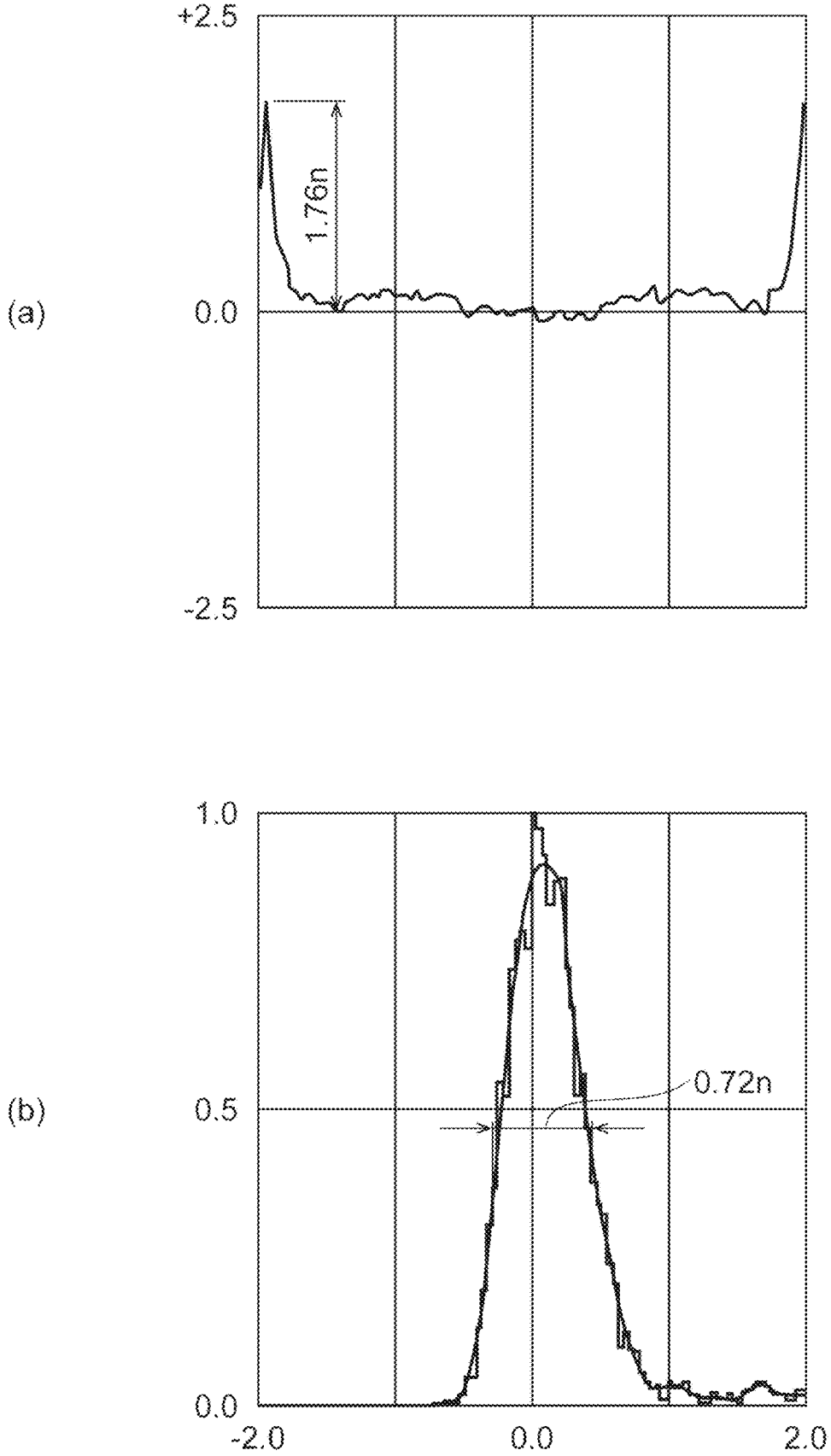
FIG. 8 is a diagram showing a cathode transit time difference and a transit time spread in a photomultiplier tube using a first-stage dynode as a first example.
Figure 9:
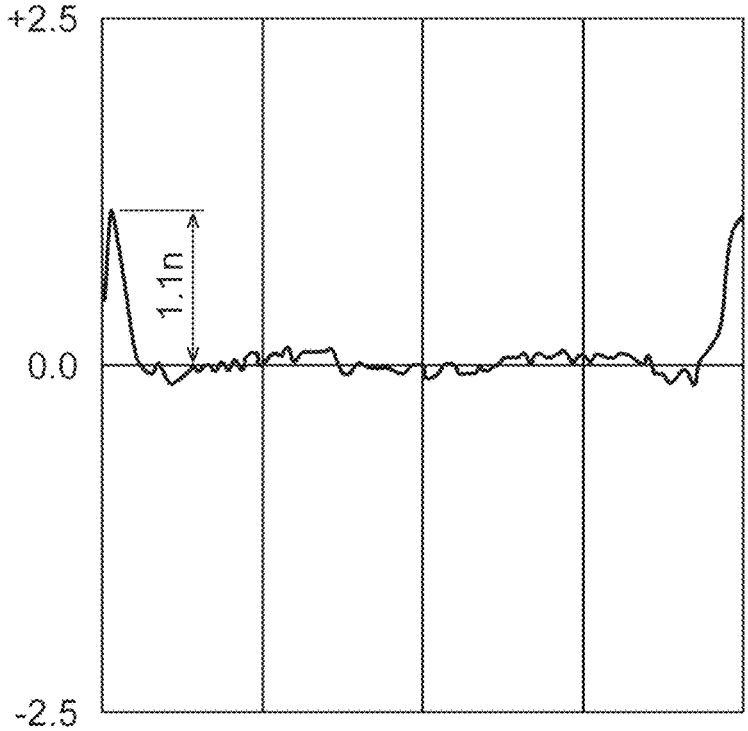
FIG. 9 is a diagram showing a cathode transit time difference and a transit time spread in a photomultiplier tube using a first-stage dynode as a second example.
Figure 9:
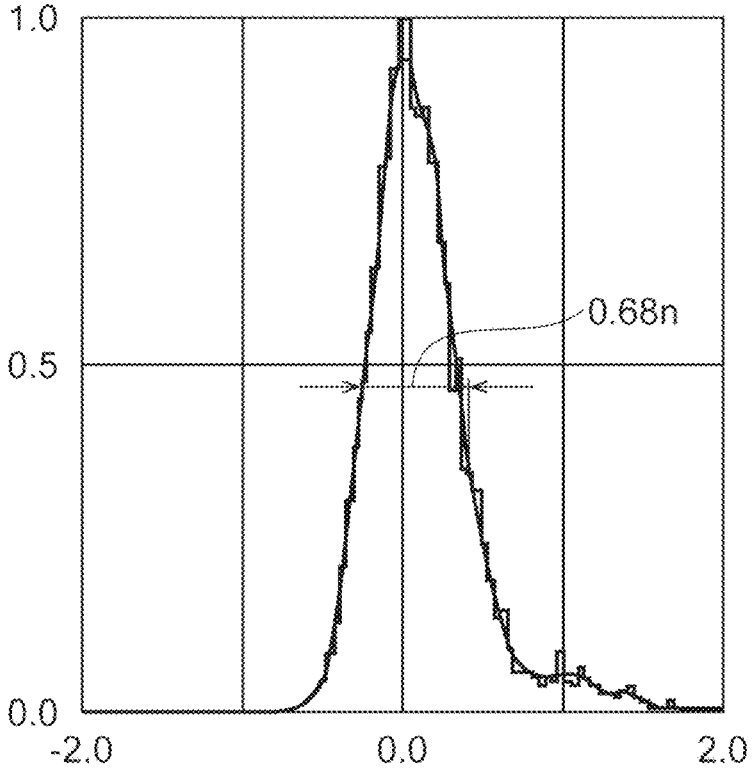
Figure 10:
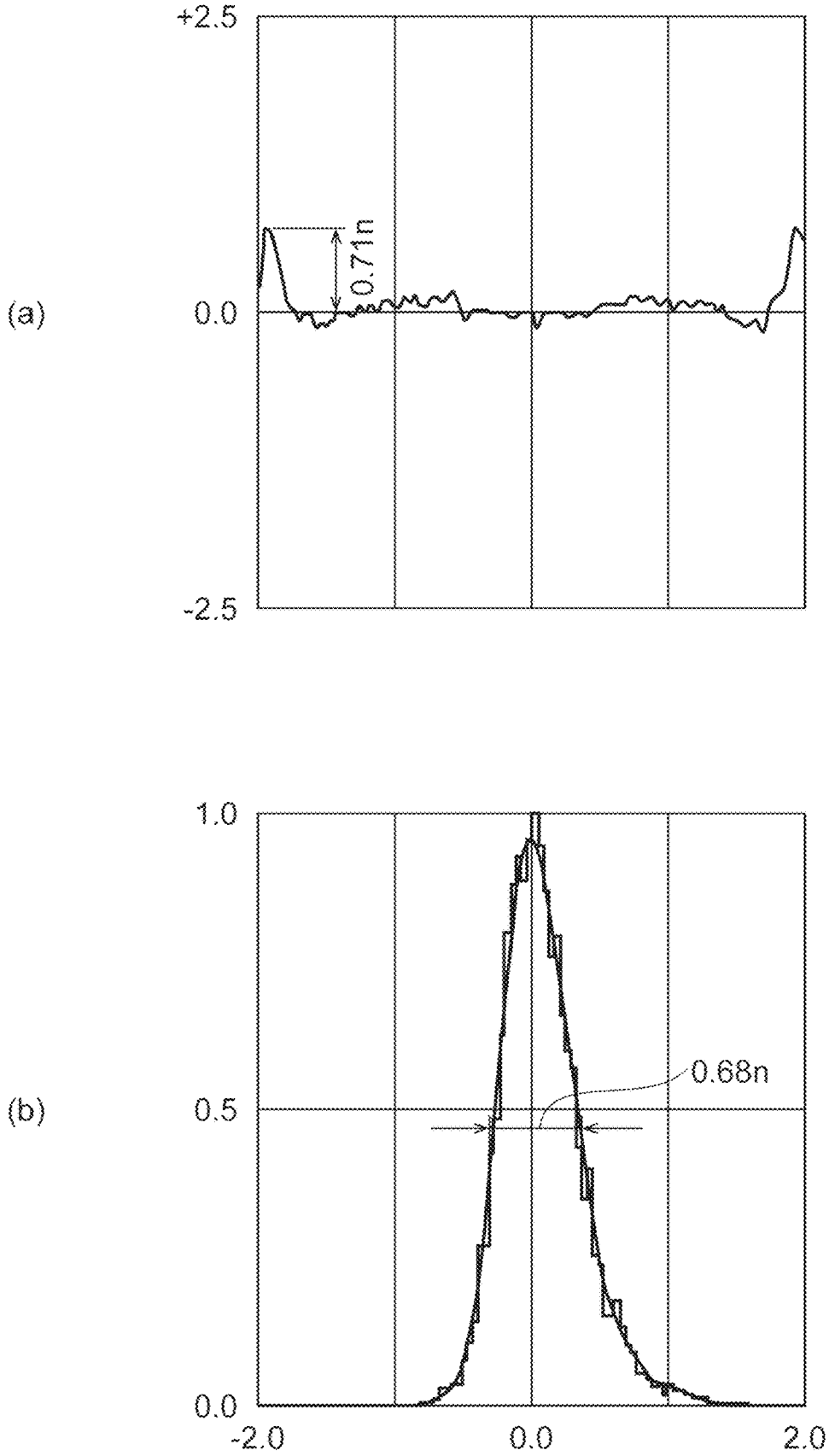
FIG. 10 is a diagram showing a cathode transit time difference and a transit time spread in a photomultiplier tube using a first-stage dynode as a third example.
Figure 11:
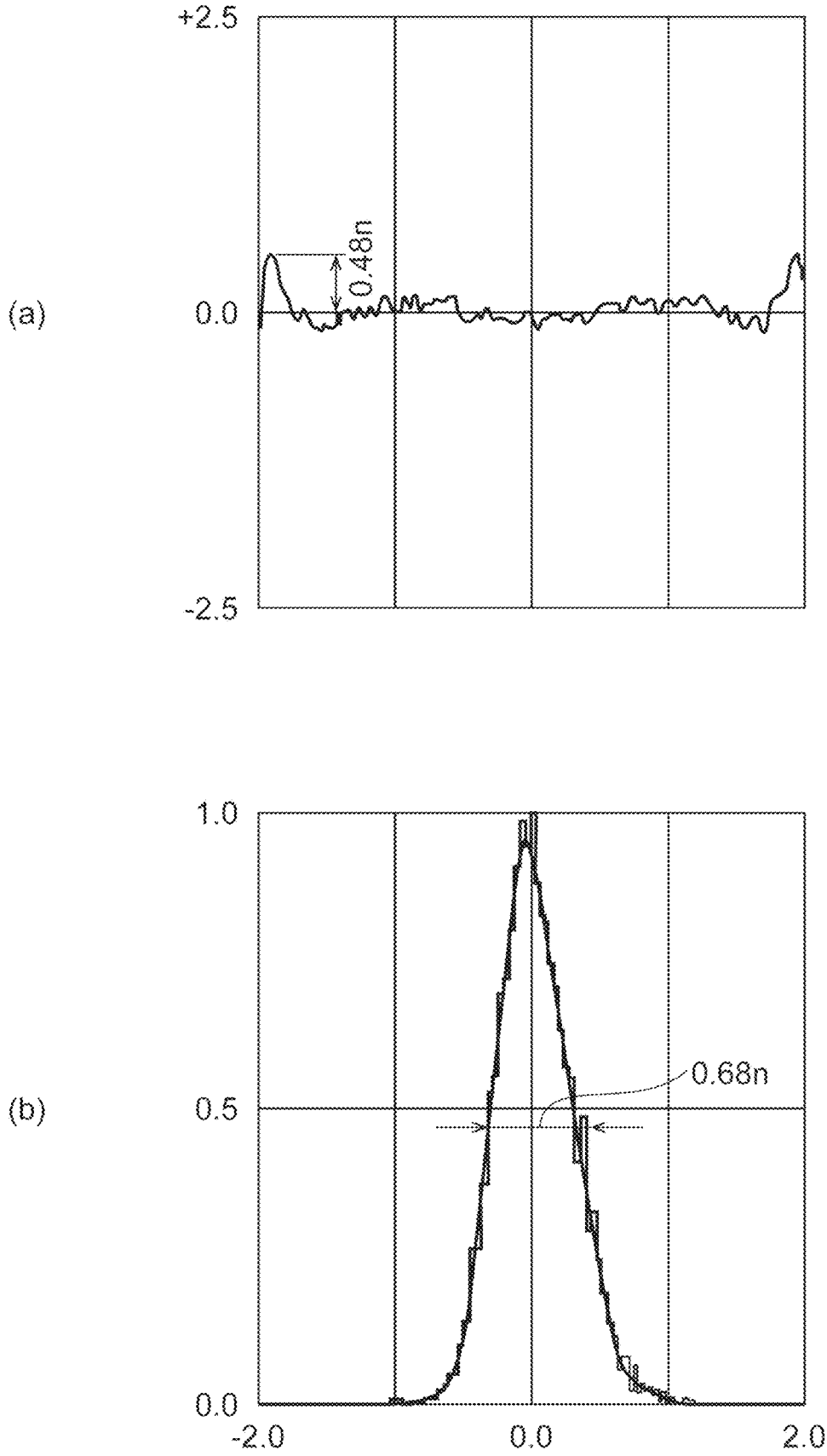
FIG. 11 is a diagram showing a cathode transit time difference and a transit time spread in a photomultiplier tube using a first-stage dynode as a fourth example.

(a) of FIG. 8 is a diagram showing a cathode transit time difference in a photomultiplier tube using the first-stage dynode as the first example, and (b) of FIG. 8 is a diagram showing a transit time spread in that case. (a) of FIG. 9 is a diagram showing a cathode transit time difference in a photomultiplier tube using the first-stage dynode as the second example, and (b) of FIG. 9 is a diagram showing a transit time spread in that case. (a) of FIG. 10 is a diagram showing a cathode transit time difference in a photomultiplier tube using the first-stage dynode as the third example, and (b) of FIG. 10 is a diagram showing a transit time spread in that case. (a) of FIG. 11 is a diagram showing a cathode transit time difference in a photomultiplier tube using the first-stage dynode as the fourth example, and (b) of FIG. 11 is a diagram showing a transit time spread in that case.

As shown in (a) of FIGS. 8, 9, 10, and 11, in the first-stage dynode as the second example, the first-stage dynode as the third example, and the first-stage dynode as the fourth example, the cathode transit time difference in the X-axis direction was made more uniform at both end portions in the X-axis direction, compared with the photomultiplier tube using the first-stage dynode as the first example. In addition, as shown in (b) of FIGS. 8, 9, 10, and 11, in the first-stage dynode as the second example, the first-stage dynode as the third example, and the first-stage dynode as the fourth example, the transit time spread in the X-axis direction was further reduced compared with the photomultiplier tube using the first-stage dynode as the first example.

From the above simulation result, it can be said that it is more preferable that the radius of curvature R of each of the pair of side surfaces forming the electron emission surface is greater than 2 mm in order to suppress the cathode transit time difference and the transit time spread in the photomultiplier tube.

Next, the reason why it is more preferable that R≥0.1L is satisfied in the first-stage dynode 11 will be described together with the simulation result.

From the simulation result described above, R≥0.1L is not satisfied in the first-stage dynode as the first example (L: 30.6 mm, R: 2 mm), and R≥0.1L is satisfied in the first-stage dynode as the second example (L: 30.6 mm, R: 4 mm), the first-stage dynode as the third example (L: 30.6 mm, R: 6 mm), and the first-stage dynode as the fourth example (L: 30.6 mm, R: 8 mm). Therefore, it was confirmed by simulation that it could be said that satisfying R≥0.1L in the first-stage dynode even if the width L of the electron emission surface in the X-axis direction was not 30.6 mm was more preferable for suppressing the cathode transit time difference and the transit time spread in the photomultiplier tube.

First, as a simulation model, a first-stage dynode as a first comparative example and a first-stage dynode as a fifth example were prepared. Each first-stage dynode corresponds to one formed by pressing a stainless steel plate having a thickness of 0.3 mm. In the first-stage dynode as the first comparative example, the width L of the electron emission surface in the X-axis direction was 34 mm, and the radius of curvature R of each of a pair of side surfaces was 0 mm (that is, the first-stage dynode as the first comparative example has the same configuration as the first-stage dynode 15 shown in FIG. 6). In the first-stage dynode as the fifth embodiment, the width L of the electron emission surface in the X-axis direction was 34 mm, and the radius of curvature R of each of a pair of side surfaces was 5 mm (that is, the first-stage dynode as the fifth example has the same configuration as the first-stage dynode 11 described above).

In a simulation corresponding to a case where the first-stage dynode as the first comparative example and the first-stage dynode as the fifth example were attached to the same photomultiplier tube and the photomultiplier tube was operated under the same conditions, the cathode transit time difference in the X-axis direction was measured. (a) of FIG. 12 is a diagram showing a cathode transit time difference in a photomultiplier tube using the first-stage dynode as the first comparative example, and (b) of FIG. 12 is a diagram showing a cathode transit time difference in a photomultiplier tube using the first-stage dynode as the fifth example.

Figure 12:
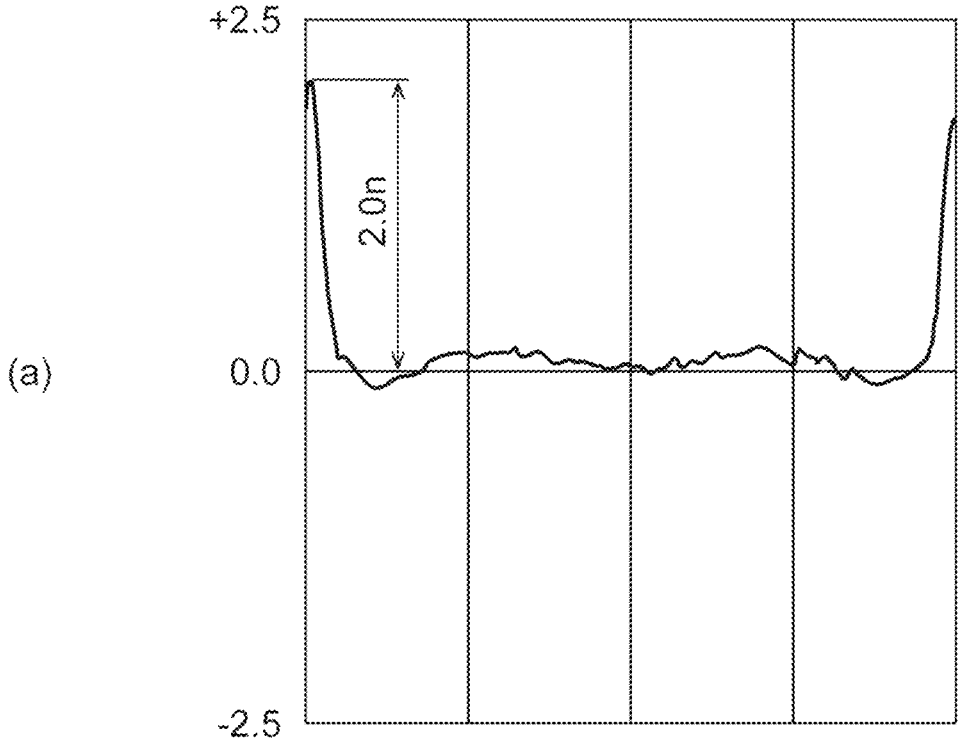
FIG. 12 is a diagram showing a cathode transit time difference in a photomultiplier tube using a first-stage dynode as a first comparative example and a photomultiplier tube using a first-stage dynode as a fifth example.
Figure 12:
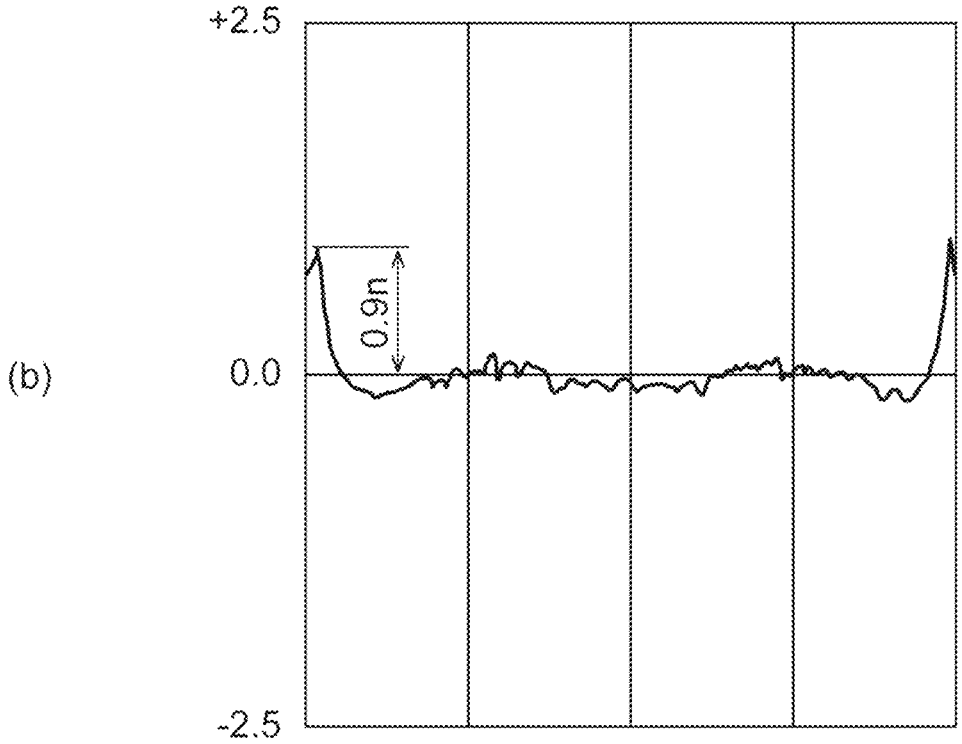

As shown in (a) and (b) of FIG. 12, in the photomultiplier tube using the first-stage dynode as the fifth example, the cathode transit time difference in the X-axis direction was made uniform at both end portions in the X-axis direction, compared with the photomultiplier tube using the first-stage dynode as the first comparative example. From this simulation result, it can be said that satisfying R≥0.1L in the first-stage dynode is more preferable for suppressing the cathode transit time difference and the transit time spread in the photomultiplier tube.

Modification Examples

The present disclosure is not limited to the embodiment described above. For example, the material and shape of each component are not limited to the materials and shapes described above, and various materials and shapes can be adopted. As an example, the first holding portion 113 is not limited to the rectangular plate shape, and may have other shapes such as a semicircular plate shape. In addition, the first-stage dynode 11 may not have the first holding portion 113.

In addition, an edge portion of each of the pair of second holding portions 114 on one side may be formed so as to protrude from the bottom wall portion 111 and an edge portion of each of the pair of side wall portions 112 on one side, or may be formed so as to be recessed from the bottom wall portion 111 and an edge portion of each of the pair of side wall portions 112 on one side. In addition, the first-stage dynode 11 may not have the pair of second holding portions 114. In this case, for example, a metal film having the same shape as the second holding portion 114 may be formed on the surface of each of a pair of substrates interposing the first-stage dynode 11 therebetween in the X-axis direction by evaporation or the like, and the metal film may be disposed in a portion where the second holding portion 114 is missing.

In addition, a plurality of electron passage openings facing the electron emission surface 11*a* may be formed so that the photoelectrons incident on the electron emission surface 11*a* and the secondary electrons emitted from the electron emission surface 11*a* pass through different electron passage openings. In addition, the bottom surface 111*a* forming the electron emission surface 11*a* may include a flat region.

In addition, the bottom wall portion 111, the pair of side wall portions 112, the first holding portion 113, and the pair of second holding portions 114 may not be formed in a plate shape. As an example, the bottom wall portion 111, the pair of side wall portions 112, the first holding portion 113, and the pair of second holding portions 114 may be formed in a block shape, and the electron emission surface 11*a* described above may be formed by cutting or the like.

REFERENCE SIGNS LIST

1: photomultiplier tube, 3: photocathode, 7: anode, 10: dynode, 11: first-stage dynode, 11*a*: electron emission surface, 11*b*: electron passage opening, 12: second-stage dynode, 111: bottom wall portion, 111*a*: bottom surface, 112: side wall portion, 112*a*: side surface.

The invention claimed is:

1. A first-stage dynode to be used in a photomultiplier tube, comprising:

a bottom wall portion; and a pair of side wall portions extending from both end portions of the bottom wall portion in a predetermined direction to one side, wherein an electron emission surface is formed by a bottom surface of the bottom wall portion on the one side and a pair of side surfaces of the pair of side wall portions on the one side, each of the pair of side surfaces is a curved surface that is curved in a concave shape in a cross section parallel to the predetermined direction, and assuming that a width of the electron emission surface in the predetermined direction is L and a radius of curvature of each of the pair of side surfaces is R, $R \geq 0.1L$ is satisfied.

2. The first-stage dynode according to claim 1, wherein the radius of curvature of each of the pair of side surfaces is greater than 2 mm.

3. The first-stage dynode according to claim 1, wherein the bottom surface is a curved surface that is curved in a concave shape in a cross section perpendicular to the predetermined direction.

4. The first-stage dynode according to claim 1, wherein the electron emission surface faces one electron passage opening.

5. A photomultiplier tube, comprising:

a photocathode;

a plurality of stages of dynodes; and an anode, wherein the plurality of stages of dynodes include a first-stage dynode and a second-stage dynode arranged on a predetermined plane, the first-stage dynode includes:

a bottom wall portion; and a pair of side wall portions extending from both end portions of the bottom wall portion in a predetermined direction to the photocathode side and the second-stage dynode side, the predetermined direction being perpendicular to the predetermined plane, in the first-stage dynode, an electron emission surface is formed by a bottom surface of the bottom wall portion on the photocathode side and the second-stage dynode side and a pair of side surfaces of the pair of side wall portions on the photocathode side and the second-stage dynode side, each of the pair of side surfaces is a curved surface that is curved in a concave shape in a cross section parallel to the predetermined direction, and assuming that a width of the electron emission surface in the predetermined direction is L and a radius of curvature of each of the pair of side surfaces is R, $R \geq 0.1L$ is satisfied.

* * * * *